US005162623A

United States Patent [19]

Tachino

[11] Patent Number: 5,162,623

[45] Date of Patent: Nov. 10, 1992

[54] ELEVATOR MONITOR AND CONTROL SYSTEM WITH MULTIPLE POWER SOURCES

[75] Inventor: Kenzo Tachino, Inazawa, Japan

[73] Assignee: Mitsubishi Denki Kabushiki Kaisha, Tokyo, Japan

[21] Appl. No.: 775,554

[22] Filed: Oct. 15, 1991

[30] Foreign Application Priority Data

Oct. 16, 1990 [JP] Japan ..... 2-275231

[51] Int. Cl.[5] ..... B66B 3/00

[52] U.S. Cl. ..... 187/130; 187/102; 307/64

[58] Field of Search ..... 187/133, 134, 129, 114; 307/64, 87

[56] References Cited

U.S. PATENT DOCUMENTS

| | | | |
|---|---|---|---|
| Re. 33,087 | 10/1989 | Bradford et al. | 307/64 |
| 4,142,609 | 3/1979 | Tachino | 187/114 |
| 4,627,518 | 12/1986 | Meguerdichian et al. | 187/134 |
| 4,890,005 | 12/1989 | Schornack | 307/87 |
| 4,930,604 | 6/1990 | Schienda et al. | 187/133 |

FOREIGN PATENT DOCUMENTS

| | | |
|---|---|---|
| 53-73756 | 6/1978 | Japan . |
| 1-256477 | 10/1989 | Japan . |

*Primary Examiner*—A. D. Pellinen
*Assistant Examiner*—Lawrence E. Colbert
*Attorney, Agent, or Firm*—Leydig, Voit & Mayer

[57] ABSTRACT

An elevator monitor and control system includes at least one elevator control apparatus, a monitor panel, and a power line interconnecting the elevator control apparatus and the monitor panel. The monitor panel includes an inverter power source backed up by a battery. Each elevator control apparatus includes a first power source for supplying normal power to an internal circuit of the elevator control apparatus, a second power source connected to the power line for supplying power to the elevator control apparatus upon the failure of the first power source, and a control circuit for determining which of the first and second power sources should supply power. A signal conversion control circuit disposed within each of the monitor panels and the elevator control apparatus exchanges data concerning car position, elevator control and the like between the monitor panel and the elevator control apparatus by series transmission through the power line.

4 Claims, 2 Drawing Sheets

ELEVATOR MONITOR AND CONTROL SYSTEM WITH MULTIPLE POWER SOURCES

BACKGROUND OF THE INVENTION

This invention relates to a system for remotely monitoring and controlling elevator operating conditions. More particularly it relates, to an elevator monitor and control system in which the system has a battery back-up so that the final stop position of the elevator car may be detected even upon power failure.

Positional control of an elevator system is generally achieved by digital position control in which the elevator car position is detected by counting pulses generated as the car travels along a hoistway. While the display of the elevator car position in the car or on the landing floor may be turned off upon power failure without any serious problem, it is necessary that the car position be displayed on a monitor panel even during a power failure. Also, when a power failure takes place while the elevator car is travelling, the displayed car position often differs from the actual stop position because of the idle run of the elevator car after the completion of the display process.

Japanese Patent Laid-Open No. 53-73756 discloses a battery back-up system in which the display is updated until the elevator car comes to a complete stop after the occurrence of a power failure. Also, Japanese Patent Laid-Open No. 1-256477 discloses a system in which exchanging of an elevator operating data between a elevator control apparatus and a monitoring panel is achieved by a series transmission system. In this system, a display data processing function is added in one part of transmission control and is backed up by a battery.

In displaying the car position in a conventional elevator monitor and control system, a battery back-up is necessary for each elevator control apparatus, and a car position display data transmission signal line between the elevator control apparatus and the monitor panel is necessary for each elevator control apparatus, making the elevator monitor and control system expensive.

SUMMARY OF THE INVENTION

Accordingly, one object of the present invention is to provide an elevator monitor and control system free from the above described problem of the conventional monitor and control system.

Another object of the present invention is to provide an elevator monitor and control system in which a back-up battery is not necessary for each elevator control apparatus.

Another object of the present invention is to provide an elevator monitor and control system in which there is no need for the provision of a data transmission signal line for a monitor panel.

With the above objects in view, the elevator monitor and control system of the present invention comprises at least one elevator control apparatus, a monitor panel, and a power line interconnecting the elevator control apparatus and the monitor panel. The monitor panel comprises an inverter power source backed up by a battery and connected to the power line. Each elevator control apparatus comprises a first electric power source for supplying a normal power source to an internal circuit of the elevator control apparatus, a second electric power source connected to the power line for supplying a power source to the internal circuit of the elevator control apparatus upon the failure of the first power source, and a control device for controlling which of the first and second power sources should supply the power source. The elevator monitor and control system further comprises a signal conversion control device disposed within the monitor panel and the elevator control apparatus for exchanging data concerning car position, elevator control, and the like between the monitor panel and the elevator control system by series transmission through the power line.

During power failure, the internal circuitry of the elevator control apparatus is supplied with electric power from the monitor panel so that the final stop position of the elevator car can be detected, and the car position data, together with other elevator control data, is transmitted through the power line to the monitor panel where the car position is displayed.

BRIEF DESCRIPTION OF THE DRAWINGS

The present invention will become more readily apparent from the following detailed description of a preferred embodiment of the present invention considered in conjunction with the accompanying drawings, in which.

DESCRIPTION OF THE PREFERRED EMBODIMENT

Figure 1:
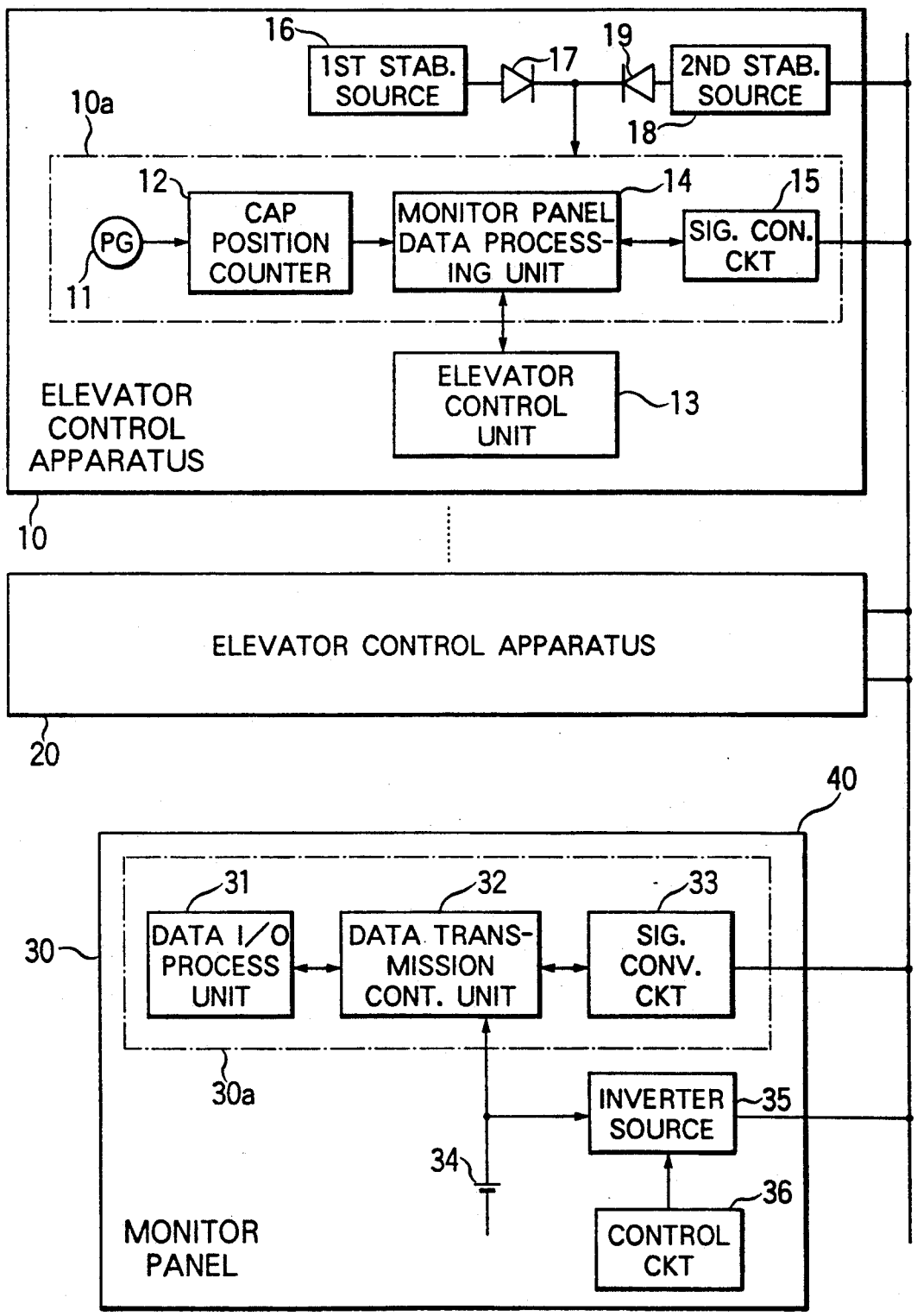
FIG. 1 is a block diagram illustrating one embodiment of the elevator monitor and control system of the present invention.

FIG. 1 is a block diagram illustrating one embodiment of the elevator monitor and control system of the present invention. The elevator monitor and control system comprises at least one (two, for example) elevator control apparatuses 10 and 20 of identical structure, one monitor panel 30, and an electric power line 40 interconnecting the elevator control apparatuses 10 and 20 and the monitor panel 30.

The elevator control apparatus 10 comprises a pulse generator 11 for generating pulses according to travel of an elevator car (not shown), a car position counter 12 connected to an output of the pulse generator 11 for counting the generated pulses, and an elevator control unit 13 for generating an elevator control signal. The elevator control apparatus 10 also includes a signal conversion control means comprising a monitor panel data processing unit 14 connected to an output of the car position counter 12 and interconnected to the elevator control unit 13 for achieving control of the car position detection from the data indicative of the car position from the car position counter 12 and the elevator control signal data as well as by data exchange with respect to the monitor panel 30. Interconnected to the monitor panel data processing unit 14 is a signal conversion circuit 15 which may be a known power line carrying transmission interface connected to the power line 40. The elevator control apparatus 10 further comprises a first power source, such as a first stabilized power source 16 having a first diode 17 forward-connected to its output, and a second power source, such as a second stabilized power source 18 having a second diode 19 forwardly connected to its output. The second power source is connected to the power line 40. The first diode 17 and the second diode 19 are connected to each other at their cathodes, thereby constituting control means for controlling which of the first stabilized power source 16 and the second stabilized power source 18 should supply power to an internal circuit 10*a* including the circuits 11, 12, 14, and 15.

The monitor panel 30 comprises a data input/output processing unit 31 for processing the data at the input and the output sides, a data transmission control unit 32 in the form of signal conversion means interconnected to the data input/output processing unit 31 for converting and processing the data, and a signal conversion circuit 33 also connected to the power line 40 and similar to the signal conversion circuit 15 of the elevator control apparatus 10. The monitor panel 30 also comprises a battery 34, an inverter power source 35 connected between the positive terminal of the battery 34 and the power line 40 for converting the d.c. current from the battery 34 into an a.c. current of a predetermined frequency, and a control circuit 36 connected to the inverter power source 35 for stopping the operation of the inverter power source 35 after the lapse of a predetermined time from the occurrence of a power failure.

Figure 2:
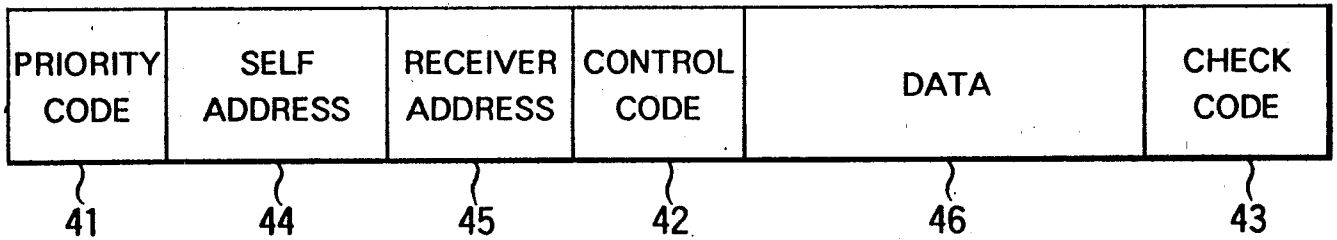
FIG. 2 is a diagram illustrating one example of a transmission signal format that can be used in the present invention.

FIG. 2 is a diagram illustrating a transmission signal format used in the present invention, in which the format comprises a priority code 41 for determining the priority of the conflicting data, a control code 42 for determining the kind, length, etc. of the data, and a check code 43 for checking the transmission error. The format also includes a self address 44, a receiver address 45, and data 46. The transmission signal format may be any suitable format as long as the signal transmission between each of the elevator control apparatuses 10 and 20 can be achieved in addition to signal transmission between the respective elevator control apparatuses 10 and 20 and the monitor panel 30.

During normal operation of the elevator monitor and control system, in the monitor panel 30, an internal circuit 30*a* including the circuits 31 to 33 of the monitor panel 30 is supplied with power from the charge circuit (not shown) of the battery 34, and the d.c. current from the charge circuit is supplied through the power line 40 to the elevator control apparatuses 10 and 20 after being converted into an a.c. current by the inverter power source 35. On the other hand, in the elevator control apparatus 10, the electric power is provided to the internal circuit 10*a* from the first stabilized power source 16 through the diode 17.

The pulse generator 11 generates pulses in accordance with the travel of the elevator car, and the car position counter 12 counts the number of the generated pulses to generate the car position data. The monitor panel data processing unit 14 detects and processes the car position on the basis of the car position data to display it on the elevator panel 13, and performs similar processing of the elevator control data from the elevator control unit 13, the results of this processing being supplied to the power line 40 through the signal conversion circuit 15 after the data is converted into the transmission signal format illustrated in FIG. 2.

In the monitor panel 30, the signal transmitted through the power line 40 is received by the signal conversion circuit 33, processed by the data transmission control unit 32 and displayed by the data input/output processing unit 31.

On the other hand, the signal from the monitor panel 30 is transmitted to the receiving elevator control apparatus such as the elevator control apparatus 10 through the power line 40 from the signal conversion circuit 33 after the data is converted into the transmission signal format illustrated in FIG. 2 in the data transmission control unit 32.

Upon the occurrence of a power failure of the first stabilized power source 17, in the monitor panel 30, the battery 34 backs up the failed source so that the function of the internal circuit 30*a* including the circuits 31 to 33 is not impeded, and the inverter power source 35 continues to supply power to the power line 40. In the elevator control apparatus 10, the power source is switched by the first and the second diodes 17 and 19 from the first stabilized power source 16 to the second stabilized power source 18. Also, the power is kept supplied to the internal circuit 10*a* from the power line 40 through the second stabilized power source 18 and the second diode 19. Therefore, the car position can continue to be detected by the pulse generator 11, the car position counter 12 and the monitor data processing unit 14 until the car come to a complete stop, and the car position data is transmitted from the signal conversion circuit 15 through the power line 40 to the monitor panel 30, on which the car final stop position is displayed.

After the lapse of a predetermined time from the time point of the power failure, the control circuit 36 causes the inverter power source 35 to turn off, thereby preventing the battery 34 from being wasted. The above predetermined time is set so as to be sufficient for the elevator car to come to a complete stop. While the signal transmission between the elevator control apparatuses 10 and 20 and the monitor panel 30 is not possible when the inverter power source 35 is turned off, there is no problem in the display of the elevator car position when the received data just before the transmission abnormality is held on the monitor panel 30.

As has been described, the elevator monitor and control system of the present invention comprises at least one elevator control apparatus, a monitor panel and a power line interconnecting the elevator control apparatus and the monitor panel. The monitor panel comprises an inverter power source backed up by a battery and connected to the power line. Each of the elevator control apparatus comprises a first electric power source for supplying normal power to an internal circuit of the elevator control apparatus, a second electric power source connected to the power line for supplying power to the internal circuit of the elevator control apparatus upon the failure of the first power source, and a control device for controlling which of the first and second power sources should supply the power source. The elevator monitor and control system further comprises a signal conversion control device, disposed within each of the monitor panel and the elevator control apparatus, for exchanging data concerning car position, elevator control, and the like between the monitor panel and the elevator control system by series transmission through the power line.

Therefore, it is not necessary for the back-up battery for properly operating the system during a power failure to be provided in each elevator control apparatus. Also, there is no need for the provision of a plurality of expensive data transmission signal lines for the monitor panel, whereby a simple and less expensive elevator monitor and control system can be obtained.

What is claimed is:

1. An elevator monitor and control system, comprising:

at least one elevator control apparatus;

a monitor panel; and a power line interconnecting said elevator control apparatus and said monitor panel;

said monitor panel including an inverter power source backed up by a battery and connected to said power line;

each of said elevator control apparatus including a first electric power source for supplying a normal power source to an internal circuit of said elevator control apparatus, a second electric power source connected to said power line for supplying a power source to said internal circuit of said elevator control apparatus upon the failure of said first power source and control means for controlling which of said first and second power sources should supply said power source; and signal conversion control means disposed within each of said monitor panel and said elevator control apparatus, for exchanging data concerning car position, elevator control and the like between each of said monitor panel and said elevator control apparatus by series transmission through said power line.

2. An elevator monitor and control system as claimed in claim 1, wherein said control means comprises first and second diodes connected in opposite directions.

3. An elevator monitor and control system as claimed in claim 1, wherein said signal conversion control means comprises a monitor panel data processing unit.

4. An elevator monitor and control system comprising:

a power line for supplying power to an elevator car;

an elevator control apparatus for installation on an elevator car and including a first power source, a second power source connected to the power line, first data transmission means connected to the power line for serial transmission of data via the power line, and switching means for connecting one of the power sources to the first data transmission means; and a monitor panel for installation remote from elevator car on which the elevator control apparatus is mounted and including a backup battery, an inverter connected between the battery and the power line, and second data transmission means connected to the power line for serial transmission of data to the first data transmission means via the power line.

* * * * *